US005981816A

United States Patent [19]

Sinquin et al.

[11] Patent Number: 5,981,816

[45] Date of Patent: Nov. 9, 1999

[54] METHOD FOR INHIBITING OR RETARDING HYDRATE FORMATION OR AGGLOMERATION IN A PRODUCTION EFFLUENT

[75] Inventors: Anne Sinquin, Rueil Malmaison; Marie Velly, Paris; Jean-Pierre Durand, Chatou, all of France

[73] Assignee: Institut Francais du Petrole, France

[21] Appl. No.: 08/857,048

[22] Filed: May 15, 1997

[30] Foreign Application Priority Data

May 15, 1996 [FR] France ..... 96/06200

[51] Int. Cl.[6] ..... C07C 7/20

[52] U.S. Cl. ..... 585/15; 95/153

[58] Field of Search ..... 585/15, 95

[56] References Cited

U.S. PATENT DOCUMENTS

| | | | |
|---|---|---|---|
| 2,690,814 | 10/1954 | Reid | 95/190 |
| 2,865,453 | 12/1958 | Widmyer | 585/15 |
| 3,644,107 | 2/1972 | Clark | 48/190 |
| 4,973,775 | 11/1990 | Sugier et al. | 585/15 |
| 5,244,878 | 9/1993 | Sugier et al. | 507/90 |
| 5,420,370 | 5/1995 | Sloan, Jr. | 585/15 |
| 5,432,292 | 7/1995 | Sloan, Jr. | 585/15 |
| 5,460,728 | 10/1995 | Klomp et al. | 210/698 |
| 5,583,273 | 12/1996 | Colle et al. | 585/15 |
| 5,600,044 | 2/1997 | Colle et al. | 585/15 |
| 5,648,575 | 7/1997 | Klomp et al. | 585/15 |
| 5,744,665 | 4/1998 | Costello et al. | 585/15 |

FOREIGN PATENT DOCUMENTS

| | | |
|---|---|---|
| 0 323 774 | 7/1989 | European Pat. Off. . |
| 0 323 775 | 7/1989 | European Pat. Off. . |
| 94/12761 | 6/1994 | WIPO . |
| 95/19408 | 7/1995 | WIPO . |

*Primary Examiner*—Walter D. Griffin
*Assistant Examiner*—Nadine Preisch
*Attorney, Agent, or Firm*—Millen, White, Zelano, & Branigan, P.C.

[57] ABSTRACT

The inhibiting or retarding hydrate formation, growth and/or agglomeration in a fluid comprising water and gases, is accomplished by addition of at least one hydrosoluble homopolymer or copolymer derived from at least one nitrogen-containing monomer selected from cationic monomers, for example those containing at least one quaternary ammonium moiety, amphoteric monomers, for example those containing at least one quaternary ammonium moiety and at least one carboxylate or sulphonate moiety, and various neutral monomers, said hydrosoluble homopolymer or copolymer being neutral or anionic, or consisting of a polyampholyte. The homopolymer, copolymer or mixture of polymers optionally mixed with an alcohol is generally incorporated into the fluid to be treated at a concentration of 0.05% to 5% by weight with respect to the quantity of water in the medium.

17 Claims, No Drawings

METHOD FOR INHIBITING OR RETARDING HYDRATE FORMATION OR AGGLOMERATION IN A PRODUCTION EFFLUENT

BACKGROUND OF THE INVENTION

The invention concerns a process for inhibiting or retarding hydrate formation, growth and/or agglomeration in natural gas, petroleum gas or other gases, using at least one additive. Gases which form hydrates can comprise at least one hydrocarbon selected from methane, ethane, ethylene, propane, propene, n-butane and isobutane, and possibly $H_2S$ and/or $CO_2$.

Such hydrates are formed when water comes into the presence of a gas either in its free state or dissolved in a liquid phase such as a liquid hydrocarbon, and when the temperature of the mixture, including water, gas and possibly liquid hydrocarbons such as oil, drops below the thermodynamic temperature for hydrate formation, this temperature being fixed for a known gas composition and fixed pressure.

Hydrate formation is a problem, particularly in the gas and oil industry where hydrate formation conditions can be satisfied. One way of reducing the production costs of crude oil and gas both from the point of view of investment and exploitation, particularly in the case of offshore production, is to reduce or cut out treatments applied to the crude or gas to be transported from the field to the coast and leave all or part of the water in the fluid to be transported. Such offshore treatments are generally carried out on a platform located on the surface close to the field, so that the effluent, which is initially hot, can be treated before the thermodynamic hydrate formation conditions are reached due to cooling of the effluent with sea water.

However, in practice, when the thermodynamic conditions required for hydrate formation are satisfied, hydrate agglomeration causes the transport lines to block by creation of plugs which prevent the passage of crude or gas.

The formation of hydrate plugs can stop production and result in large financial losses. Further, restarting the installation, especially in the case of offshore production or sea transportation, can be a long process as the hydrates formed are very difficult to decompose. When the production from a submarine natural gas or oil and gas field containing water reaches the surface of the sea bed and is transported along the sea bottom, the reduction in the temperature of the effluent produced can mean that the thermodynamic hydrate formation conditions are satisfied and the hydrates formed bind together or agglomerate and block the transfer lines. The temperature on the sea bed can, for example, be 3° C. or 4° C.

Favourable conditions for hydrate formation can also be satisfied onshore when, for example, the ambient air temperature is low and the lines are not buried, or are not deeply buried in the ground.

In order to overcome these disadvantages, the prior art has sought to use substances which, when added to the fluid, can act as inhibitors by reducing the thermodynamic hydrate formation temperature. Such substances include alcohols such as methanol, or glycols such as mono-, di- or triethyleneglycol. Such a solution is very expensive as the quantity of inhibitors to be added can be as high as 10% to 40% of the water content and those inhibitors are difficult to recover completely.

Insulation of the transport lines has also been recommended, to prevent the temperature of the transported fluid from reaching the hydrate formation temperature under the operating conditions. This type of technique is also very expensive.

The use of additives which can modify the hydrate formation mechanism has also been recommended, in which instead of agglomerating rapidly with each other and forming plugs, the hydrates formed disperse in the fluid without agglomerating and without obstructing the lines. Examples are: our European patent application EP-A-0 323 774, which describes the use of non-ionic amphiphilic compounds selected from the esters of polyols and carboxylic acids, which may or may not be substituted, and compounds with an imide function; our European patent application EP-A-0 323 775, which describes the use of compounds from diethanolamides of fatty acids or fatty acid derivatives; U.S. Pat. No. 4,856,593 which describes the use of surfactants such as organic phosphates, phosphate esters, phosphonic acids, and salts and esters thereof, inorganic polyphosphates and esters thereof, and homopolyacrylamides and acrylamide-acrylate copolymers; and European patent application EP-A-0 457 375, which describes the use of anionic surfactants such as alkylarylsulphonic acids and their alkali metal salts.

Amphiphilic compounds obtained by reacting at least one succinic derivative selected from the group formed by polyalkenylsuccinic acids and anhydrides with at least one polyethyleneglycol monoether have also been proposed for reducing the tendency of natural gas hydrates, petroleum gas hydrates or other gas hydrates to agglomerate (European patent application EP-A-0 582 507).

The use of additives which can inhibit or retard hydrate formation and/or growth has also been recommended. Examples are European patent application EP-A-0 536 950 which describes the use of tyrosine derivatives, International patent application WO-A-93 25798 which describes the use of homopolymers and copolymers of N-vinyl-2-pyrrolidone and mixtures thereof, International patent application WO-A-94 12761 and U.S. Pat. No. 5 432292 which describe the use of poly(N-vinyl-2-pyrrolidone), hydroxyethylcellulose and mixtures thereof or a terpolymer based on N-vinyl-2-pyrrolidone, N-vinyl-s-caprolactame and dimethylaminoethyl methacrylate sold under the trade name GAFFIX VC-713. International patent application WO-A-95 19408 more generally describes the use of aliphatic polymers containing carbonylated N-heterocycles in complex formulations. This is also the case in International patent application WO-A-95 32356, which describes the use of terpolymers based on N-vinyl-2-pyrrolidone, acrylamidomethylpropanesulphonate and acrylamide. Finally, International patent applications WO-A-95 17579 and WO-A-96 04462 describe the use of allylated ammonium, sulphonium and phosphonium derivatives, used either alone or mixed with a corrosion inhibitor.

SUMMARY OF THE INVENTION

We have now discovered that certain hydrosoluble copolymers which can be neutral or positively charged homopolymers or copolymers, or polyampholytes, and which derive from one or more nitrogen-containing monomers, can inhibit or retard hydrate formation, growth and/or agglomeration in natural gas, petroleum gas or other gases, at low concentrations, with an efficiency which is substantially superior to the compounds previously described.

Thus the invention provides a process for inhibiting or retarding hydrate formation, growth and/or agglomeration in a fluid comprising water and a gas, under conditions in which hydrates can form (from the water and gas), characterized in that the fluid has incorporated therein at least one hydrosoluble homopolymer or copolymer generally defined as deriving from at least one nitrogen-containing monomer selected from cationic (or positively charged) monomers, amphoteric (i.e., comprising both a positive and a negative charge) monomers and neutral monomers selected from:

monomers [A] containing at least one tertiary amine moiety and optionally at least one amide moiety on a side chain and having general formula [1]:

[1]

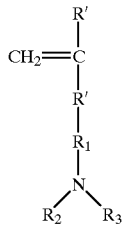

where R' is a hydrogen atom or a methyl group, R" is selected from divalent groups —COO—, -CO—NH—, —CO—NH—CO—NH— or $C_6$—, $R_1$ is selected from the following divalent groups: $—(CH_2)_n—$, where $1 \leqq n \leqq 3$, $—C(CH_3)_2—$, $—C(CH_3)_2—(CH_2)_2$ and $CH_2—CH(OH)CH_2—$, $R_2$ is a hydrogen atom or a methyl, ethyl or isopropyl radical, $R_3$ is a hydrogen atom or a methyl or ethyl radical;

monomers [B] containing at least one amide moiety on a side chain and having general formula [2]:

[2]

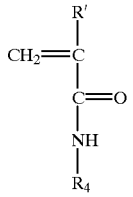

where R' is a hydrogen atom or a methyl group and $R_4$ is a $—C(CH_3)_2—CH_2—CO—CH_3$ or $CH_2OH$ group;

monomers [C] containing a pendent aromatic nitrogen-containing radical and having general formula [3]:

[3]

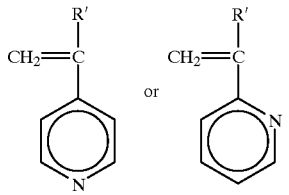

where R' is a hydrogen atom or a methyl group;

monomers [D] containing a succinimide moiety on a side chain and having general formula [4]:

[4]

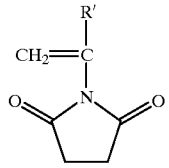

where R' is a hydrogen atom or a methyl group;

and monomers [E] having general formula [5]:

$$(CH_2{=}CH—(CH_2))_2—N—R_5 \quad [5]$$

where $R_5$ is a $CH_2H_{2n+1}$ chain, where $1 \leqq n \leqq 10$, or a hydroxy group or a $(CH_2)_2—CO—NH_2$ group.

Examples of neutral monomers which illustrate these formulae are dimethyl-amino-ethyl acrylate and dimethyl-amino-ethyl methacrylate.

More particular cationic monomers which satisfy the definition of the polymers of the invention are those which contain quaternary ammonium groups. They may be monomers derived from quaternisation by chloromethylation, sulphomethylation, sulphoethylation or chlorobenzylation of type [A], [C] or [E] described above. These cationic monomers [F], [G] and [H] respectively have general formulae [6], [7] and [8] below:

monomers [F], having general formula [6]:

[6]

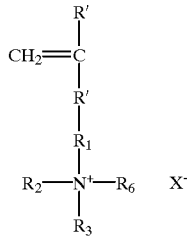

where R' is a hydrogen atom or a methyl group, R" is selected from divalent groups —COO—, —CO—NH—, —CO—NH—CO—NH— or $C_6H_4$-, $R_1$ is selected from the following divalent groups: $—(CH_2)_n—$, where $1 \leqq n \leqq 3$, $—C(CH_3)_2—$, $—C(CH_3)_2—(CH_2)_2—$ or $CH_2—CH(OH)CH_2—$, $R_2$ is a hydrogen atom or a methyl, ethyl or isopropyl radical, $R_3$ is a hydrogen atom or a methyl or ethyl radical, $R_6$ is selected from methyl, ethyl or benzyl groups and X is a chloride ion or a $CH_3OSO_3$— ion;

monomers [G], having general formula [7]:

[7]

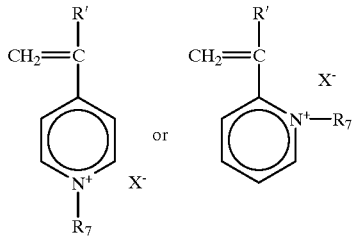

where R' is a hydrogen atom or a methyl group, $R_7$ is a $—C(CH_3)_2—CO—CH_3$ group, $—CH_2OH$ group, a methyl, ethyl or berzyl group, and X is a chloride ion or a $CH_3OSO_3^-$ ion;

and monomers [H], having general formula [8]:

$$(CH_2{=}CH{-}(CH_2))_2{-}N^+{-}R_5R_6X^- \quad [8]$$

where $R_5$ is a $C_nH_{2n+1}$alkyl chain, where $1 \leqq n \leqq 10$, a hydroxy group or a $(CH_2)_2$— CO—$NH_2$ group, R6 is selected from methyl, ethyl or benzyl groups and X is a chloride ion or a $CH_3OSO_3^-$ ion.

Examples of cationic monomers are ethyl-methacrylate trimethyl ammonium chloride, methacrylamido-N-propyl-trimethyl ammonium chloride and diallyl-dimethyl ammonium chloride.

Amphoteric monomers [I], [J] and [K] (containing both a positive charge and a negative charge) which fall within the definition of the polymers of the invention have the following general formula:

monomers [I], having general formula [9]:

[9]

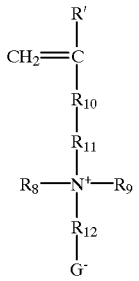

where R', $R_8$ and $R_9$ are either hydrogen atoms or methyl groups, $R_{10}$ is selected from the following divalent groups: —COO— or —CO—NH—, $R_{11}$ and $R_{12}$ are selected from the following divalent groups: $-(CH_2)_n$, where $1 \leqq n \leqq 3$, $-C(CH_3)_2-$ or $-C(CH_3)_2-(CH_2)_2-$ and $G^-$ is a negatively charged carboxylate or sulphonate type group;

monomers [J], having general formula [10]:

[10]

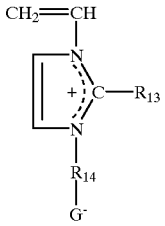

where $R_{13}$ is a hydrogen atom or a methyl group, $R_{14}$ is selected from the divalent groups $-(CH_2)_n-$, where $1 \leqq n \leqq 4$, or $-CH_2-C_6H_4-$ and $G^-$ is a negatively charged carboxylate or sulphonate type group;

and monomers [K], having general formula [11]:

[11]

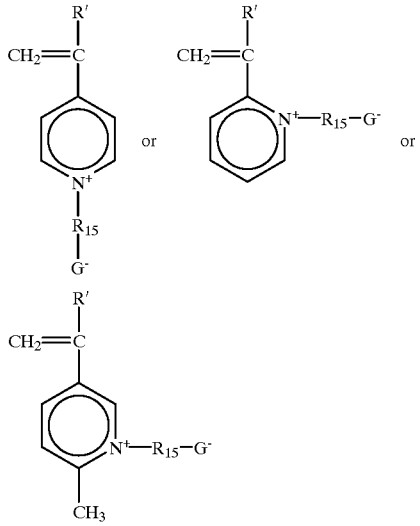

where R' is a hydrogen atom or a methyl group, $R_{15}$ is a divalent $-(CH_2)_n$ type group, where $1 \leqq n \leqq 4$, and $G^-$ is a negatively charged carboxylate or sulphonate type group.

Examples of amphoteric monomers are ethyl- acrylate trimethyl ammonium methosulphonate.

The cationic monomers, amphoteric monomers and neutral monomers [A] to [K] defined in the above description can be included in homopolymers or copolymers, in any proportion, i.e., from 0 to 100 mole % for each.

The invention also provides for the use, as additives, of copolymers resulting from the association of at least one of the monomers described above (cationic monomers, amphoteric monomer and/or neutral monomers [A]to [K], with at least one anionic (or negatively charged) monomer and/or at least one neutral monomer other than those described above.

More particularly, the anionic monomers are those containing carboxylate groups or sulphonate groups, more precisely acrylate, methacrylate, itaconate, 2-acrylamido-2-methyl-propane sulphonate, 2-methacryloyloxy ethane sulphonate, 3-acrylamido-3-methyl butanoate, styrene sulphonate, styrene carboxylate, vinyl sulphonate, maleic anhydride or maleic acid monomers. One or more other neutral nitrogen-containing monomers such as acrylamide, alkyl acrylamide or vinyl acetamide type monomers can be associated with the cationic monomers, amphoteric monomers and/or neutral monomers [A] to [K] described above.

In these copolymers, the proportions of cationic monomers, amphoteric monomers, neutral monomers [A] to [K] anionic monomers and/or additional neutral monomers can vary, for each monomer, from 1% to 99 mole %, for example, more particularly from 10% to 70 mole %.

The cationic monomers, amphoteric monomers and neutral monomers [C] to [K] described above can also be associated with one or more other neutral nitrogen-containing N-vinyl lactame type monomers, in particular N-vinyl-2-pyrrolidone, N-vinyl-5-valerolactame and N-vinyl-ε-caprolactame.

In these copolymers, the proportions of cationic monomers, amphoteric monomers, neutral monomers [C] to [K] and additional neutral monomers can vary, for each monomer, from 1% to 99 mole %, for example, more particularly from 10% to 70 mole %.

Bearing in mind the definition of the homopolymers and copolymers given above, with respect to the nature of the monomers from which they can be constituted, the homopolymers and copolymers of the invention can consist of neutral, cationic or polyampholytic (co)polymers (the latter type containing both positively charged and negatively charged monomers).

The polymers described in the present invention can be linear or branched. They can have a mass of 3000 to several million.

In the process of the invention, the homo and copolymers described above can be added to the fluid to be treated either alone or in the form of mixtures of two or more thereof. When a plurality of copolymers is used in a mixture, they may be copolymers which differ from each other, for example, by the nature of the moieties of at least one type and/or by a different composition of at least one moiety and/or by their molecular mass.

The homo or copolymers, and their mixtures of any proportions, can be added to the fluid to be treated at concentrations which are in general 0.05% to 5% by weight, preferably 0.1% to 2% by weight, with respect to the water.

Further, the homo or copolymers recommended for use as additives can be mixed with one or more alcohols (monoalcohols or polyols) which contain, for example, 1 to 6 carbon atoms, more particularly mono-, di- or tri-ethylene glycol, ethanol or methanol, the latter being the preferred alcohol. This alcohol (or these alcohols) is (are) generally added in proportions of 0.5% to 20% by weight, preferably 1% to 10% by weight, with respect to the water present in the fluid to be treated. The copolymers considered in respect of the invention can thus first be dissolved in a hydro-alcoholic medium and then added to the medium to be treated so as to obtain final homo or copolymer concentrations of generally 0.05% to 3% by weight, preferably 0.1% to 1% by weight, with respect to the water present in the fluid to be treated.

The conjugated action of the presence of kinetic additive (s) such as the polymers of the invention and alcohol(s) such as methanol in the medium can retard hydrate formation extremely satisfactorily, at the same time reducing the quantities of additives used (alcohols and polymers) and, in particular, allowing a much lower temperature range to be used.

The hydrosoluble homo or copolymers considered in the process of the invention can be used either in a pure water medium, for example in water of condensation, or in a saline medium, for example in production water.

The invention will be better understood from the following non limiting experiments. Examples 4 to 9 are given by way of comparison and do not form part of the invention.

EXAMPLE 1

The experimental additive selection procedure was carried out on hydrates of tetrahydrofuran (THF). A pure water/THF solution (80/20 by weight) forms hydrates at atmospheric pressure at 4° C. ("Kinetic Inhibitors of Natural Gas Hydrates", E. D. Sloan et al., 1994).

The apparatus used was constituted by tubes with a 16 mm diameter into which 8 ml of an aqueous solution containing 20% by weight of THF, possibly containing the additive to be tested, was introduced. An 8 mm diameter glass ball was introduced into each tube to ensure proper agitation of the solution. The tubes were placed on a rotating stirrer which rotated at 20 turns/min. The stirrer was placed in a refrigerated chamber at 2° C.

The aim of this test was to determine the latency time preceding hydrate formation. The latency time corresponds to the interval measured between the time when the tubes are introduced into the refrigerated chamber and the time when hydrate formation is observed (appearance of cloudiness).

Each series of tests was carried out in the presence of a reference mixture containing no additive and the latency times provided for any one additive corresponded to an average of the time measured for 16 tests.

Under the operating conditions described above, the pure water/THF solutions had an average latency time of 35 minutes.

Under the operating conditions used, addition of 0.5% by weight of a copolymer containing 10 mole % of dimethyl-amino-ethyl methacrylate moieties (MADAME) and 90 mole % of acrylamide moieties (AA) multiplied the latency time by approximately 4.5, and addition of 0.5% by weight of a poly(ethyl-methacrylate trimethyl ammonium chloride) (MAC) produced an induction time which was on average 7 times greater than that of pure water. Addition of 0.3% by weight of a copolymer containing 55% of acrylamide moieties (AA) and 45 mole % of diallyl-dimethyl ammonium chloride (DADMAC) moieties multiplied the latency time by 5.

Finally, addition of 0.5% by weight of poly(ethyl-acrylate trimethyl ammonium methosulphate) or the addition of 0.3% by weight of a copolymer containing 50 mole % of N-vinyl-2-pyrrolidone (NVP) moieties and 50 mole % of ethyl-methacrylate trimethyl ammonium chloride (MAC) or a copolymer containing 32 mole % of [3-(2-acrylamido-2-methyl-propyl-dimethyl-ammonio)-1-propane sulphonate] (AMPDAPS) and 68 mole % of acrylamide (AA) moieties inhibited formation of THF hydrates for a period of more than 6 hours.

Similarly, addition of a mixture of DADMAC+AA/MADME (70/30 by moles) in a 60/40 weight ratio, at a concentration of 0.3% by weight with respect to water also inhibited formation of THF hydrates for a period of over 6 hours.

EXAMPLE 2

The experimental procedure of Example 1 was repeated, replacing the pure water with a pure water+5% by weight methanol mixture and reducing the temperature of the refrigerated chamber to −1° C.

Under these conditions, the average latency time of pure water+5% methanol/THF solutions in the absence of additive was 29 minutes.

Addition of 0.15% by weight with respect to the water, of a copolymer containing 50 mole % of dimethyl-amino-ethyl acrylate (ADAM) moieties and 50 mole % of acrylic acid (acrylic ac) moieties to the water +5% methanol solution multiplied the latency time by more than 5.

EXAMPLE 3

The experimental procedure of Example 1 was repeated, replacing the pure water with a solution of 3.5% by weight of NaCl, and the temperature of the refrigerated chamber was reduced to 0C. Under these conditions, the average latency time of the NaCl/THF solutions in the absence of additive was 42 minutes.

Addition of 0.5% by weight of a poly(diallyl-dimethyl ammonium chloride) (DADMAC) multiplied the latency time by about 5. Addition of 0.5% by weight of a poly[3-(2-acrylamido-2-methyl-propyl-dimethyl-ammonio)-1-propane sulphonate] (AMPDAPS) multiplied the latency time by about 6. Finally, addition of 0.5% by weight of a terpolymer containing 50 mole % of acrylamide moieties (AA), 35 mole % of methacrylamido-N-propyl-trimethyl ammonium chloride (MAPTAC) moieties and 15 mole % of sodium acrylate moieties resulted in an average latency time which was more than 7 times higher than that obtained without an additive.

Addition of 0.3% by weight of a terpolymer containing 60 mole % of acrylamide type moieties, 25 mole % of acrylamido-methyl-propane sulphonate (AMPS) and 15 mole % of methacrylamido-N-propyl-trimethyl ammonium chloride (MAPTAC) moieties or 0.3% by weight of a PVP/AMPDAPS copolymer (60/40 in moles) inhibited the formation of THF hydrates for a period of more than 6 hours.

EXAMPLES 4, 5, 6, 7, 8 AND 9 (comparative)

Different additives which were outside the scope of the invention were tested for comparison under the conditions described above (Examples 1, 2 and 3):

EX. 4: Polyvinyl pyrrolidone (molecular weight 10000; 0.5% by weight);

EX. 5: Polyacrylamide (0.5% by weight).

EX. 6: Acrylamide/sodium acrylate copolymer (0.5% by weight).

EX. 7: Tetrabutyl ammonium chloride (0.5% by weight).

EX. 8: HE-300 (N-vinyl-2-pyrrolidone/acrylamidomethylpropane sulphonate/acrylamide terpolymer: 0.3% by weight).

EX. 9: GAFFIX VC-713 (N-vinyl-2-pyrrolidone/N-vinyl-ε-caprolactame/dimethylaminoethyl methacrylate; 0.3% by weight).

Under these test conditions, the additives had induction times preceding hydrate formation which were substantially shorter than the substances within the context of the invention, as shown in the summary of results in the following table.

| Additive (mole % of moieties) | Concentration (% by weight) | Operating conditions | Latency time (min) |
|---|---|---|---|
| Ex. 1: | | | |
| no additive | / | pure water/THF, 2° C. | 35 |
| MADAME/AA (10/90) | 0.5 | pure water/THF, 2° C. | 155 |
| MAC | 0.5 | pure water/THF, 2° C. | 270 |
| ADQUAT | 0.5 | pure water/THF, 2° C. | >360 |
| DADMAC/AA (45/55) | 0.3 | pure water/THF, 2° C. | 180 |
| PVP/MAC (50/50) | 0.3 | pure water/THF, 2° C. | >360 |
| AMPDAPS/AA (32/68) | 0.3 | pure water/THF, 2° C. | >360 |
| DADMAC + AA/MADAME (70/30) [40/60 by weight] | 0.3 | pure water/THF, 2° C. | >360 |
| Ex. 2: | | | |
| no additive | / | water + 5% MeOH/THF, −1° C. | 29 |
| ADAME/acrylic ac (50/50) | 0.15 | water + 5% MeOH/THF, −1° C. | 148 |
| Ex. 3: | | | |
| no additive | / | 3.5% NaCl/THF, 0° C. | 42 |
| DADMAC | 0.5 | 3.5% NaCl/THF, 0° C. | 220 |
| AMPDAPS | 0.5 | 3.5% NaCl/THF, 0° C. | 248 |
| MAPTAC/AA/acrylic ac (50/35/15) | 0.5 | 3.5% NaCl/THF, 0° C. | 302 |
| AA/AMPS/MAPTAC (60/25/15) | 0.5 | 3.5% NaCl/THF, 0° C. | >360 |
| PVP/AMPDAPS (60/40) | 0.3 | 3.5% NaCl/THF, 0° C. | >360 |
| Ex. 4: | 0.5 | pure water/THF, 2° C. | 45 |
| Ex. 5: | 0.5 | pure water/THF, 2° C. | 100 |
| Ex. 6: | 0.5 | pure water/THF, 2° C. | 71 |
| Ex. 7: | 0.5 | pure water/THF, 2° C. | 48 |
| Ex. 8: | 0.3 | pure water/THF, 2° C. | 150 |
| Ex. 9: | 0.3 | 3.5% NaCl/THF, 0° C. | 204 |

EXAMPLE 10

In order to test the effectiveness of the substances used in the process of the invention in the presence of hydrates of methane, hydrate formation tests using gas and water were carried out using the apparatus described below.

The apparatus comprised a 6 meter circuit constituted by tubes with an internal diameter of 7.7 mm, a 2 liter reactor comprising a gas inlet and outlet, an intake and a discharge for the mixture of water and additive initially introduced. The reactor kept the circuit under pressure. Tubes with an analogous diameter to those in the circuit ensured circulation of the fluid from the circuit to the reactor and vice versa via a gear pump placed between them. A sapphire cell integrated into the circuit allowed the circulating liquid, and thus any hydrates which were formed, to be observed.

In order to determine the effectiveness of the additives of the invention, the fluid (water and additive) was introduced into the reactor. The unit was then pressurised to 7 MPa. The solution was homogenised by circulation in the circuit and the reactor then the circuit was isolated from the reactor. The pressure was held constant by adding methane and the temperature was gradually reduced (0.5° C./min) from 17° C. to 5° C., corresponding to the selected experimental temperature.

The principle of these tests was to determine the temperature at which methane hydrates were formed in the circuit and the latency time preceding their formation. The latency time corresponded to the time measured between the start of the test (fluid circulating at 17° C.) and detection of hydrate formation (exothermic, high gas consumption). The test duration varied between several minutes and several hours: a high performance additive inhibited hydrate formation or kept them dispersed in the fluids for several hours.

In the absence of additive (medium: deionised water), methane hydrates formed at a temperature of about 10.0° C. and after an induction time of 30 minutes. Hydrate formation led to immediate blockage of the circulation of the fluid+hydrates mixture in the circuit.

Addition of 0.3% by weight of AA/AMPS/MAPTAC terpolymer (60/25/15) completely inhibited formation of methane hydrates under the pressure and temperature conditions of the test even after 24 hours of circulation.

We claim:

1. A process for inhibiting or retarding hydrate formation, growth and/or agglomeration in a fluid comprising water and a natural gas, petroleum gas or other gas, under conditions in which hydrates can form from the water and gas, said process comprising incorporating into the fluid at least one hydrosoluble homopolymer or copolymer of at least one nitrogen-containing monomer selected from cationic monomers, amphoteric monomers and neutral monomers selected from:

monomers A having general formula 1:

(I)

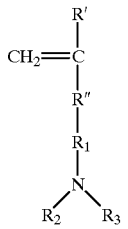

where R' is a hydrogen atom or a methyl group, R" is selected from divalent groups —COO—, —CO—NH—, —CO—NH—CO—NH— or —$C_6H_4$—, $R_1$ is selected from the following divalent groups: —$(CH_2)_n$—, where $1 \leqq n \leqq 3$, —$C(CH_3)_2$—, —$C(CH_3)_2$—$(CH_2)_2$— and —$CH_2$—CH(OH)$CH_2$—, $R_2$ is a hydrogen atom or a methyl, ethyl or isopropyl radical, $R_3$ is a hydrogen atom or a methyl or ethyl radical;

monomers C having general formula 3:

(3)

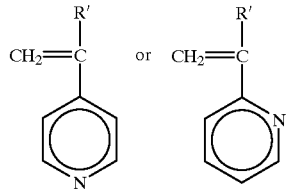

where R' is a hydrogen atom or a methyl group;

monomers D containing a succinimide moiety on a side chain and having general formula 4:

(4)

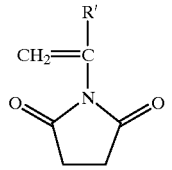

where R' is a hydrogen atom or a methyl group;

monomers E having general formula 5:

$$(CH_2{=}CH{-}(CH))_2{-}N{-}R_5 \quad (5)$$

where $R_5$ is a $C_n$—$H_{2n+1}$ chain, where $1 \leqq n \leqq 10$, or a hydroxy group or a $(CH_2)_2$—CO—$NH_2$ group; selected from:

monomers F, having general formula 6:

(6)

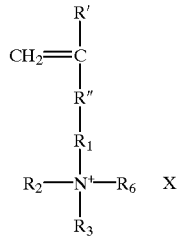

where R' is a hydrogen atom or a methyl group, R" is selected from divalent groups —COO—, —CO—NH—CO—NH— or —$C_6H_4$—, $R_1$ is selected from the following divalent groups: —$(CH_2)_n$—, where $1 \leqq n \leqq 3$, —$C(CH_3)_2$—, —$C(CH_3)_2$—$(CH_2)_2$— or $CH_2$—CH(OH)$CH_2$—, $R_2$ is a hydrogen atom or a methyl, ethyl or isopropyl radical, $R_3$ is a hydrogen atom or a methyl or ethyl radical, $R_6$ is selected from methyl, ethyl or benzyl groups and X is a chloride ion or a $CH_3OSO_3$— ion;

monomers G, having general formula 7:

(7)

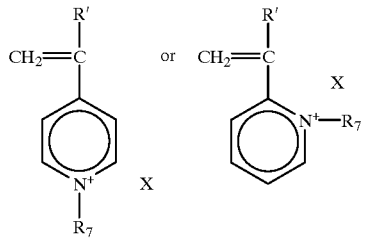

where R' is a hydrogen atom or a methyl group, $R_7$ is a $—C(CH_3)_2—CO—CH_3$ group, $—CH_2OH$ group, or a methyl, ethyl or benzyl group, and X is a chloride ion or a $CH_3OSO_3—$ ion;

monomers H, having general formula 8:

$$(CH_2{=}CH—(CH_2)_2—N^+—R_5R_6X^- \quad (8)$$

where $R_5$ is a $C_nH_{2n+1}$ alkyl chain, where $1 \leqq n \leqq 10$, a hydroxy group or a $(CH)_2—CO—NH_2$ group, $R_6$ is selected from methyl, ethyl or benzyl groups and X is a chloride ion or a $CH_3OSO_3^-$ ion, monomers I, having general formula 9:

(9)

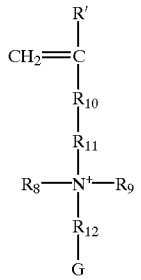

where R', $R_8$ and $R_9$ are either hydrogen atoms or methyl groups, $R_{10}$ is selected from the following divalent groups: —COO— or —CO—NH—, $R_{11}$ and $R_{12}$ are selected from the following divalent groups: $—(CH_2)_n—$, where $1 \leqq n \leqq 3$, $—C(CH_3)_2—$ or $—C(CH_3)_2—(CH_2)_2—$ and $G^-$ is a negatively charged carboxylate or sulphonate group;

monomers J, having general formula 10:

(10)

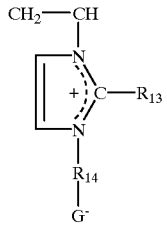

where $R_{13}$ is a hydrogen atom or a methyl group, $R_{14}$ is selected from the divalent groups $—(CH_2)_n—$, where $1 \leqq n \leqq 4$, or $—CH_2—C_6H_4—$ and $G^-$ is a negatively charged carboxylate or sulphonate group;

and monomers K, having general formula 11:

(11)

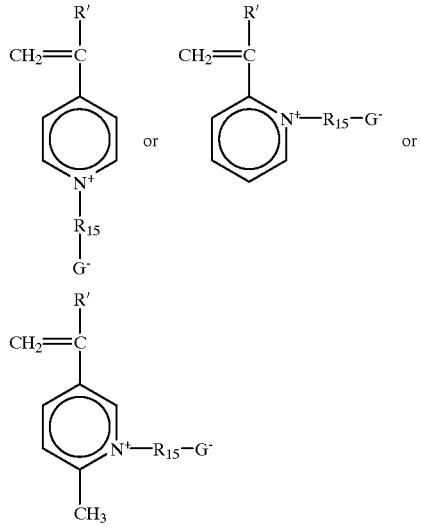

where R' is a hydrogen atom or a methyl group, $R_{15}$ is a divalent $—(CH_2)_n—$ group, where $1 \leqq n \leqq 4$, and $G^-$ is a negatively charged carboxylate or sulphonate group.

2. A process according to claim 1, wherein the monomers are other than of those of group F.

3. A process according to 1, characterized in that said polymer has a molecular mass of at least 3000.

4. A process according to 1, characterized in that said polymer is added to the fluid to be treated at a concentration of 0.05% to 5% by weight with respect to the water.

5. A process according to 1, characterized in that said polymer is added to the fluid to be treated jointly with at least one alcohol containing 1 to 6 carbon atoms.

6. A process according to claim 5, characterized in that said alcohol is selected from mono-, di- and tri-ethyleneglycol, ethanol and methanol.

7. A process according to claim 5, characterized in that said alcohol is added in a proportion of 0.5% to 20% by weight with respect to the water present in the fluid to be treated.

8. A process according to claim 5, characterized in that said polymer is first dissolved in a hydro-alcoholic medium then added to the medium to be treated to obtain a final polymer concentration of 0.05% to 3% by weight with respect to the water present in the fluid to be treated.

9. A process according to claim 1, comprising incorporating said hydrosoluble polymer in a pure water medium or in a saline medium.

10. A process according to claim 1, wherein the at least one hydrosoluble homopolymer or copolymer is at least one copolymer of at least one monomer selected from monomers A, C, D, E, F, G, H, I, J and K and at least one anionic monomer selected from monomers containing carboxylate or sulphonate groups.

11. A process according to claim 1, wherein the at least one hydrosoluble homopolymer or copolymer is at least one copolymer of at least one monomer selected from monomers A, C, D, E, F, G, H, I, J, K and at least one neutral monomer selected from an acrylamide, an alkyl acrylamide or a vinyl acetamide monomer.

12. A process according to claim 1, wherein the at least one hydrosoluble homopolymer or copolymer is at least one copolymer of at least one monomer selected from monomers C to K and at least one N-vinyl lactam monomer selected from N-vinyl-2-pyrrolidone, N-vinyl-δ-valerolactam and N-vinyl-ϵ-caprolactam in proportions of 1 mole % to 99 mole %.

13. A process according to claim 1, comprising incorporating into the fluid at least one hydrosoluble homopolymer or copolymer of at least one cationic monomer from the groups of F, G and H monomers.

14. A process according to claim 1, comprising incorporating into the fluid at least one hydrosoluble homopolymer or copolymer of at least one amphoteric monomer of the groups I, J and K.

15. A process according to claim 1, comprising incorporating into the fluid at least one hydrosoluble homopolymer or copolymer of at least one monomer from the groups A, C, D and E.

16. A process for inhibiting or retarding hydrate formation, growth and/or agglomeration in a fluid comprising water and a natural gas, petroleum gas or other gas, under conditions in which hydrates can form from the water and gas, said process comprising incorporating into the fluid at least one of the agents from the group consisting of:

(A) a terpolymer of 60 mol % acrylamide moieties, 25 mol % acrylamido-methyl-propane sulfonate moieties, and 15 mol % meth-acrylamido-N-propyl-trimethyl ammonium chloride;

(B) a copolymer of 60 mol % vinylpyrrolidone; and 40 mol % 3-(2)-methyl-propyl-dimethyl-(2)-acrylamido-(2)-methyl-propyl-dimethyl-ammonio-(1)-propane sulphonate.

17. A process according to claim 10, characterized in that said anionic monomer is selected from acrylate, methacrylate, itaconate, 2-acrylamido-2-methyl-propane sulphonate, 2-methacryloyloxy ethane sulphonate, 3-acrylamido-3-methyl butanoate, styrene sulphonate, styrene carboxylate, vinyl sulphonate, maleic anhydride or maleic acid monomers.

* * * * *